US008888302B2

(12) United States Patent
Philip et al.

(10) Patent No.: US 8,888,302 B2
(45) Date of Patent: Nov. 18, 2014

(54) DELINEATOR WITH CONFIGURABLE REFLECTOR

(75) Inventors: Blessen K. Philip, Bangalore (IN); Sundar R. Manikkam, Bangalore (IN)

(73) Assignee: 3M Innovative Properties Company, St. Paul, MN (US)

( * ) Notice: Subject to any disclaimer, the term of this patent is extended or adjusted under 35 U.S.C. 154(b) by 291 days.

(21) Appl. No.: 13/519,962

(22) PCT Filed: Dec. 21, 2010

(86) PCT No.: PCT/US2010/061534

§ 371 (c)(1), (2), (4) Date: Jun. 29, 2012

(87) PCT Pub. No.: WO2011/082030

PCT Pub. Date: Jul. 7, 2011

(65) Prior Publication Data

US 2012/0281284 A1 Nov. 8, 2012

Related U.S. Application Data

(60) Provisional application No. 61/291,839, filed on Dec. 31, 2009.

(51) Int. Cl.
*G02B 5/12* (2006.01)
*E01F 9/015* (2006.01)

(52) U.S. Cl.
CPC ..... *E01F 9/015* (2013.01)
USPC ..... 359/515

(58) Field of Classification Search
CPC ..... E01F 9/012; E01F 9/015; E01F 9/0122; G02B 7/10; G02B 7/18
USPC ..... 359/515
See application file for complete search history.

(56) References Cited

U.S. PATENT DOCUMENTS 4,080,085 A 3/1978 Dickson
4,245,922 A 1/1981 Auriemma (Continued)

FOREIGN PATENT DOCUMENTS

JP 3833020 10/2006
JP 2007231651 9/2007
WO WO 2011-084406 7/2011

OTHER PUBLICATIONS

International Search Report for PCT/US2010/061534, Mailed Aug. 31, 2011, 4 pages.

*Primary Examiner* — Euncha Cherry

(57) ABSTRACT

A delineator includes a delineator body, a positioning member, and a reflective sheet. The delineator body and the positioning member include mounting features adapted to mate with each other at a plurality of positions corresponding to different positions of the positioning member on the delineator body. By selecting one of the different positions of the positioning member on the delineator body, the user can select a visibility configuration of the delineator. In some cases the reflective sheet may be bonded to the positioning member, so that the reflective sheet is positioned at a particular place on the delineator and visible to an observer when the positioning member is mounted in the selected position. In other cases the reflective sheet may be bonded to the delineator body, and the positioning member may cover one portion of the reflective sheet and leave another portion of the reflective sheet exposed to an observer.

20 Claims, 8 Drawing Sheets

(56) References Cited

U.S. PATENT DOCUMENTS 4,343,567 A 8/1982 Sarver
2010/0266337 A1 10/2010 Lapointe
2010/0281791 A1* 11/2010 Intagliata et al. ..... 52/127.12

* cited by examiner

DELINEATOR WITH CONFIGURABLE REFLECTOR

CROSS REFERENCE TO RELATED APPLICATIONS

This application is a national stage filing under 35 U.S.C. 371 of PCT/US2010/061534, filed Dec. 21, 2010, which claims priority to Provisional Application No. 61/291,839, filed Dec. 31, 2009, the disclosure of which is incorporated by reference in its/their entirety herein.

FIELD OF THE INVENTION

This invention relates generally to delineators that are used to control vehicle traffic on roadways and the like. The invention also relates to associated articles, systems, and methods.

BACKGROUND

Traffic delineators are known. Delineators are typically used on or near roadways or other paved or unpaved surfaces where automobiles, trucks, or other motorized or unmotorized vehicles travel. Often a series of delineators are arranged along a road, lane, or path so as to highlight or increase its visibility for the benefit of vehicle operators. FIG. 1 is an idealized perspective view of a roadway 110 along which delineators 112 have been placed to mark the path or direction of the roadway. Delineators can also be used in construction work zones to help guide vehicles along rerouted paths that may be unfamiliar to the vehicle operators. Perhaps because delineators can be used to direct or "channel" traffic in a given direction, they are sometimes also referred to as channelizers.

In some cases, delineators may be used in applications where visibility from only one direction is considered important. In other cases, e.g., when placed between lanes of traffic that move in opposite directions, it may be important for the delineator to exhibit high visibility from both such directions. In still other cases, such as at intersections, it may be important for the delineator to exhibit high visibility from four or more different directions, e.g., north, south, east, and west.

An example of a known delineator design is simply a post attached to a base. For improved visibility, the post may comprise high visibility materials. For daytime visibility, the post may be fabricated from bright diffuse materials, such as white or orange paint. For nighttime visibility, retroreflective sheeting may be wrapped around a portion of the post. Retroreflective sheeting has the characteristic of directing incident light back in the general direction from which it came, regardless of the angle at which the light impinges on the surface of the sheeting. Thus, as a vehicle approaches a roadway sign or other structure on which a retroreflective sheet is mounted, light from a vehicle headlamp may impinge on the sheeting, which then reflects the light back in the general direction of the headlamp. The retroreflection occurs in a small but finite angular cone, which cone encompasses the eye of the vehicle operator so that the operator perceives the sign as being conspicuously bright and highly visible.

FIGS. 2 and 3 are provided for background purposes to exemplify two angles that may have some significance when discussing retroreflective sheeting, or other reflective sheeting. FIG. 2 is a top view of a vehicle 210 traveling in a direction 212 along a roadway 214. Reflective sheeting 216 is provided near the side of the road. Sheeting 216 is assumed to be flat and planar, and the axis 218 is perpendicular to the plane of the sheeting. (In cases where the reflective sheeting is not flat, each portion of the sheeting may be considered to be flat if the size of the portion is small enough.) Axis 220 represents the direction along which light from the vehicle headlamp impinges upon the sheeting 216. The angle $\beta$ between the axes 218 and 220 is referred to as the entrance angle for the light. A side view of this situation is shown in FIG. 3, where the vehicle headlamp (or other light source) is shown separately and labeled as 310, and the eye of the vehicle operator (or other observer) is shown separately and labeled 312. An axis 314 extends directed between the headlamp 310 and the sheeting 216. Another axis 316 extends between the sheeting 216 and the observer 312. The angle $\alpha$ between the axes 314, 316 is referred to as the observation angle.

BRIEF SUMMARY

The present application pertains to, among other things, the visibility configuration of delineators. In this regard, "visibility configuration" refers to the way in which retroreflective sheet(s), and/or other reflective sheet(s) and/or reflective material(s), are arranged relative to the delineator to provide the delineator with a given appearance in daytime and/or nighttime conditions. For example, after fabricating a given delineator body, such as a simple right circular cylinder, the delineator manufacturer may permanently apply one or more reflective sheets to the body, e.g. using an adhesive, to provide a desired visibility configuration. In one case, the visibility configuration may be characterized by a single retroreflective sheet wrapped in a band completely around the delineator body for omnidirectional nighttime visibility. In another case, the visibility configuration may be characterized by two retroreflective sheets wrapped in separate bands entirely around the delineator body. In still other cases, two or more smaller retroreflective sheets, which do not wrap entirely around the delineator body, may be adhered to different places on the delineator body. Whatever the choice, the visibility configuration of the delineator is typically fixed at the time the product leaves the manufacturing facility of the delineator supplier. The visibility configuration is typically not user-selectable.

We have developed a class of delineator designs whose visibility configuration can be readily selected from a plurality or range of options by the user, where the user may be or include e.g. an organization, group, or individual that buys the delineator and/or that is responsible for installing the delineator on a roadway or other paved or unpaved surface where automobiles, trucks, or other motorized or unmotorized vehicles travel. At least some of the disclosed delineators are designed not only to allow the user to select an initial visibility configuration for the delineator, but also to later reconfigure the delineator to different visibility configurations. The user-selected configuration, and/or the user-selected reconfiguration, is preferably accomplished by the use of at least one positioning member that has one or more mounting features designed to mate with one or more mounting features on the delineator body. The mounting features may be of the type that allow the positioning member to be mounted at a plurality of discrete positions, or over a continuous range of different positions. The positioning member may operate as a cover, whereby it may cover one or more, or a portion of, a reflective sheet that is applied to the delineator body. Such a positioning member may thus cover a different reflective sheet or a different portion of a reflective sheet depending on the selected position of the positioning member. In some embodiments, a reflective sheet may be applied to the positioning member, such that the position of the reflective sheet on the delineator is controlled by the selected placement of the positioning member on the delineator body.

The present application therefore discloses, inter alia, a delineator that includes a delineator body, a positioning member, and a first reflective sheet. The delineator body may include one or more first mounting features, and the positioning member may include one or more second mounting features that are adapted to mate with the first mounting features at a plurality of positions corresponding to different positions of the positioning member on the delineator body. The first reflective sheet may be bonded to the positioning member, or to the delineator body at one or more of the different positions. The user may select a visibility configuration of the delineator by selecting one of the different positions of the positioning member on the delineator body.

The application also discloses a delineator that includes a delineator body, a positioning member, and a first reflective sheet. The delineator body may include one or more first mounting features, and the positioning member may include one or more second mounting features adapted to mate with the first mounting features at a plurality of positions corresponding to different positions of the positioning member on the delineator body. The first reflective sheet may be bonded to the positioning member, or to the delineator body at one or more of the different positions. The positioning member may attach to the delineator body at one of the different positions to provide a visibility configuration of the delineator.

In some cases, the first reflective sheet may be bonded to the positioning member. The delineator body may include a plurality of window regions, and the positioning member may be positioned or positionable at a selected set of the window regions such that the reflective sheet is visible through the selected set of window regions. The selected set may, for example, be only one of the window regions, or it may be two or more of the window regions.

The one or more first mounting features may include a first arrangement of holes formed in the delineator body. Alternatively, the one or more first mounting features may comprise a first arrangement of protrusions formed in the delineator body. Furthermore, the one or more first mounting features may include a channel formed in the delineator body, and the one or more second mounting features may include an edge of the positioning member adapted to slidably mate with the channel. The one or more second mounting features may instead or also include a second arrangement of holes formed in the positioning member, or a second arrangement of protrusions formed in the positioning member.

In some cases, the first reflective sheet may be bonded to the delineator body, and the positioning member may be sized to cover at least a portion of the first reflective sheet. For example, the positioning member may be sized to cover only a portion of the first reflective sheet. The delineator may also include a second reflective sheet bonded to the delineator body at a different position than the first reflective sheet, and the positioning member may be sized to cover substantially all of the first reflective sheet.

In some cases, the different possible positions of the positioning member on the delineator body may include a first and second position having different heights on the delineator body. The mating of the one or more second mounting features with the one or more first mounting features may be achieved via one or more rivets, screws, and/or pins, for example. The first and second mounting features may be configured to allow the positioning member to be repositioned from one to another of the different positions. The different positions may be or include different discrete positions, or they may include a continuous range of different positions.

Related methods, systems, and articles are also discussed.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF DRAWINGS

In the figures, like reference numerals designate like elements.

DETAILED DESCRIPTION OF ILLUSTRATIVE EMBODIMENTS

Figure 4:
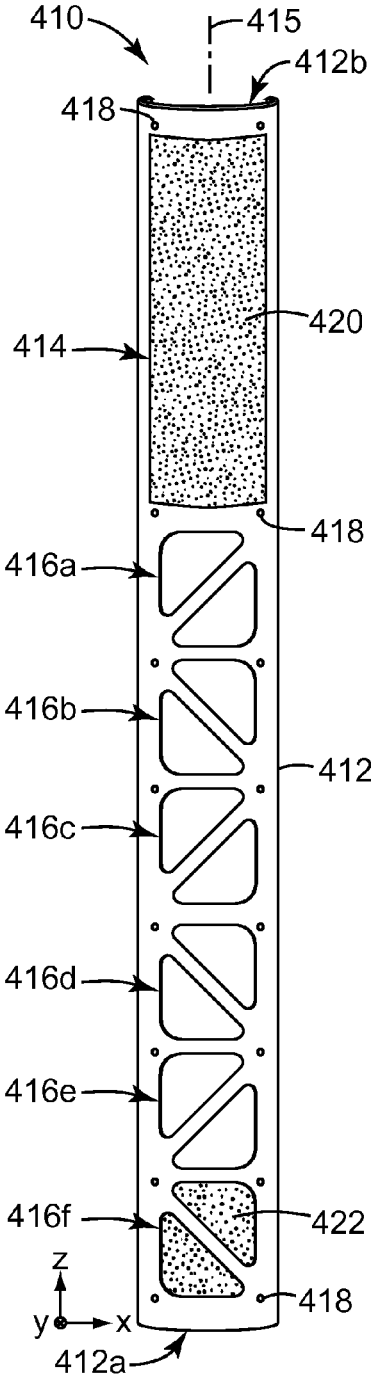
FIG. 4 is a schematic elevational view of a configurable delineator.

FIG. 4 is a schematic elevational view of an exemplary configurable delineator 410 that has been assembled, e.g. by a user of the delineator, into a first visibility configuration out of a plurality of possible visibility configurations. For convenience, the delineator is shown in relation to a Cartesian x-y-z coordinate system. The delineator 410 includes a delineator body 412, a first and second cover member 425, 426, and a first and second reflective sheet 420, 422. In this embodiment, the first and second reflective sheets 420, 422 are bonded or otherwise applied, e.g. with a suitable adhesive, to front surfaces of the first and second cover members 425, 426 respectively.

Figure 4A:
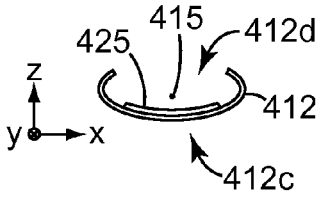
FIG. 4*a* is a schematic top view of the delineator of FIG. 4.

The delineator body 412 has a first end 412*a* and a second end 412*b*, and is generally elongated along a delineator axis 415 which may be parallel to the z-axis. The first end may be adapted to fit within an opening of a suitable base (not shown) so as to stabilize the delineator and maintain it in its upright orientation. Alternatively, the end 412*a* may be extended such that the extended lower portion of the delineator body 412 can be buried in the ground or pavement, for example, for stability. The delineator body 412 has an open "C-shaped" design in cross section as best seen in the schematic top view of FIG. 4*a*. In that figure, one can see a front side 412*c* of the delineator body and a back side 412*d*. In alternative embodiments, other closed or open cross-sectional shapes can be used, including a thin, flat shape that may be obtained by flattening out the C-shaped design of FIG. 4*a*. Some shapes may be more compatible with certain types of visibility characteristics, e.g., the C-shaped design, or a thin, flat shape, may be more compatible with a unidirectionally- or bidirectionally-visible delineator, while closed designs such as a circle or polygon may be more compatible with omnidirectionally-visible delineators, but these guidelines should not be construed as limiting.

The delineator body 412 has a plurality of window regions 414 and 416*a-f* formed by one or more apertures in the wall of the delineator body. The window region 414 consists essentially of a single large rectangular aperture, while each of the window regions 416*a-f* consists essentially of two generally triangular-shaped apertures arranged in the form of a smaller generally square or slightly rectangular area bisected by an intact portion of the delineator body wall in the form of a diagonally-oriented connective structure. The reader is reminded that the particular shapes of the depicted window regions and apertures are merely exemplary, and any other suitable shape or shapes may be used. Also, some of the apertures shown in the figure may be omitted if desired, and/or additional apertures may be added.

The delineator body 412 is provided with a plurality of mounting features 418, which may be or include an array of holes strategically placed around the periphery of each window region, for example. The mounting features 418, in combination with mounting features 421 provided on positioning member 425 (best seen in FIGS. 4*c* and 4*e*), allow for mechanical mating of the positioning member 425 at a variety of different positions on the delineator body 412. For example, the positioning member 425 may be placed behind the window region 414 (as shown), or it may be placed behind any three adjoining ones of window regions 416*a-f*. The reflective sheet 420 is bonded to cover substantially the entire front surface of the positioning member 425, as best seen in FIG. 4*c*. Thus, when the positioning member 425 is positioned behind window region 414 or behind any of the other the mentioned window regions, the reflective sheet 420 becomes visible through the selected window region(s).

Similarly, the mounting features 418, in combination with mounting features 431 provided on positioning member 430 (best seen in FIGS. 4*d* and 4*e*), allow for mechanical mating of the positioning member 430 at a variety of different positions on the delineator body 412. For example, the positioning member 430 may be placed behind window region 416*f* (as shown), or behind any of the other window regions 416*a-e*. The reflective sheet 422 is bonded to cover substantially the entire front surface of the positioning member 430, as best seen in FIG. 4*d*. Thus, when the positioning member 430 is positioned behind window region 416*f* or behind any of the other the mentioned window regions, the reflective sheet 422 becomes visible through the selected window region(s).

Thus, by selecting one of a plurality of positions on the delineator body at which to attach the positioning member 425, and by selecting another one of the plurality of positions at which to attach the positioning member 430, one of a large number of possible visibility configurations for the delineator 410 can be selected. If attachment between the mounting features on the delineator body and the mounting features on the positioning members are reversible or detachable, then the delineator may further be reconfigured into any of a large number of subsequent visibility configurations (different from the initial visibility configuration) by detaching one or both of the positioning members and reattaching it or them at different positions.

The reflective sheets 420, 422 may have the same or similar optical characteristics, or they may be substantially different. For example, the sheets may have the same apparent color, or different colors. Since a significant function of the disclosed delineators is to provide a structure that is highly visible to vehicle operators from one or more directions, the delineator 410 preferably comprises high visibility materials and components. For example, some or all of the body 412 may be made of a brightly colored (e.g., white, orange, or other color) polymer or other suitable material, or brightly colored paints or other substances, including fluorescent materials or films, may be applied to the body 412 for enhanced visibility. Shading is used in FIG. 4*a* to indicate the exposed portion of the sheets 420, 422. The sheets have a spatially uniform appearance, or they may have a striped pattern or other desired pattern, for example. The reflective sheets 420, 422 may provide high daytime visibility and/or high nighttime visibility. Sheeting that is retroreflective can provide high nighttime visibility. Retroreflective sheeting can be characterized by the sheeting's coefficient of retroreflectivity, which is typically measured in units of candelas per lux per square meter, or cd/(lux•m$^2$). Retroreflective sheeting may in some cases have a retroreflective coefficient of at least 10, or at least 100, or at least 500 cd/(lux•m$^2$) for head-on viewing ($\beta$=0), but the retroreflectivity may decrease or otherwise change with increasing entrance angle. The amount of decrease as a function of entrance angle depends on design details of the retroreflective sheeting.

Figure 1:
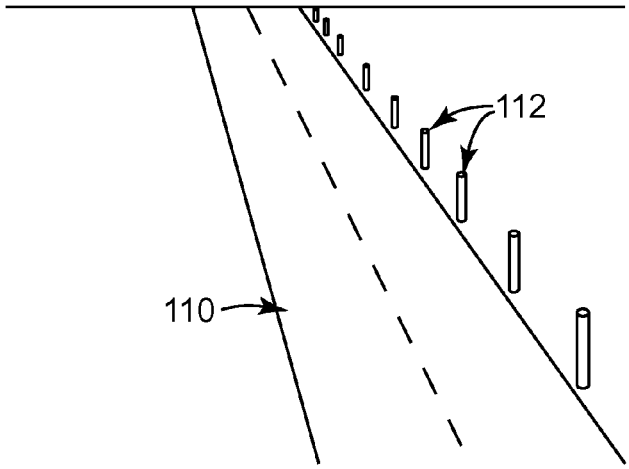
FIG. 1 is a perspective view of a roadway with delineators positioned along the roadway.
Figure 2:
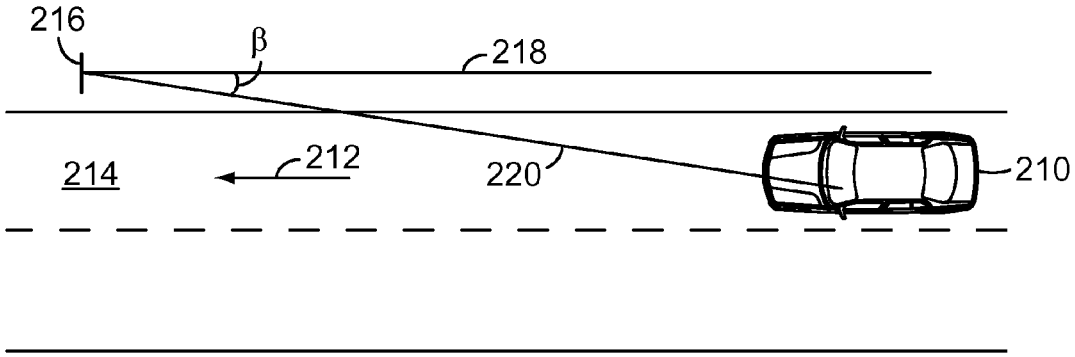
FIG. 2 is a top view of a vehicle on a roadway encountering a reflective sheet.
Figure 3:
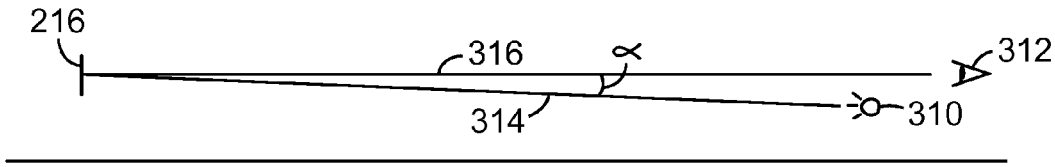
FIG. 3 is a schematic side view of selected elements of the arrangement depicted in FIG. 2.

Although retroreflective sheeting from any vendor may be used, retroreflective sheeting sold by 3M Company is preferred. Such sheeting may include 3M™ Diamond Grade™ DG$^3$ Reflective Sheeting Series 4000, 3M™ Diamond Grade™ Conspicuity Markings Series 983, or 3M™ Diamond Grade™ Flexible Prismatic School Bus Markings Series 973, for example. The Series 983 product may be considered to provide enhanced retroreflectivity at long ranges, because its retroreflectivity is particularly high at very small observation angles $\alpha$, which generally correspond to observation at large distances. The Series 4000 product, even though it also provides very good retroreflectivity at large distances, may be considered to provide enhanced retroreflectivity at shorter ranges, because its retroreflectivity decreases less than that of the series 983 sheeting as the observation angle $\alpha$ increases. Note that in addition to viewing distance, the observation angle $\alpha$ can also be affected by the vehicle size: in small vehicles, the distance from the vehicle headlamp to the vehicle operator's eye is generally smaller than for larger vehicles. Thus, at any given viewing distance, the operator of a small automobile, for example, will typically have a smaller observation angle $\alpha$ than the operator of a large truck or bus, for example. In addition to exhibiting differences as a function of observation angle $\alpha$ (FIG. 3), different retroreflective products also exhibit differences as a function of entrance angle $\beta$ (FIG. 2). Thus, for example, the retroreflectivity of the series 983 conspicuity sheeting mentioned above decreases less (for a given observation angle) than that of the series 4000 sheeting as the entrance angle increases, and can thus be said to have a wider entrance angularity.

Figure 4B:
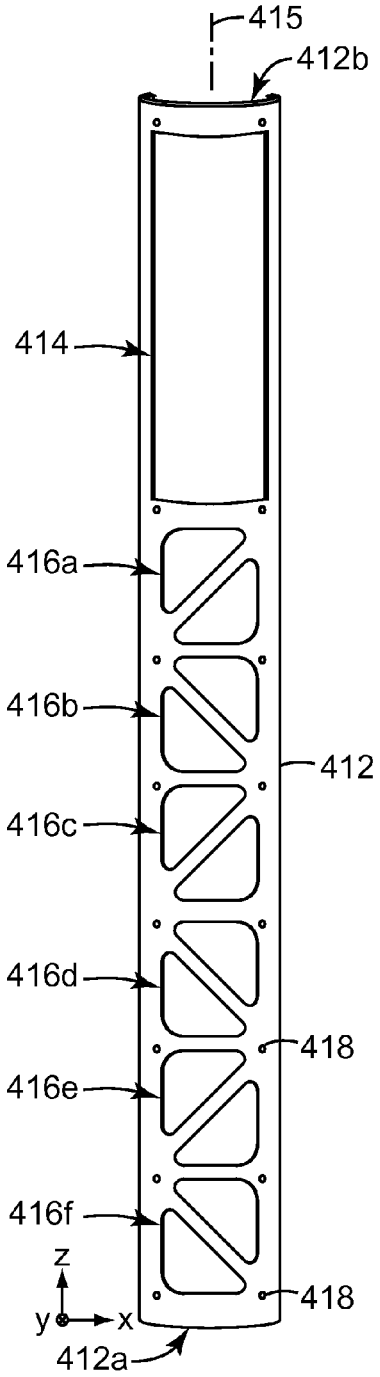
FIGS. 4*b*, 4*c*, 4*d* are schematic elevational views of individual components of the delineator of FIG. 4.
Figure 4C:
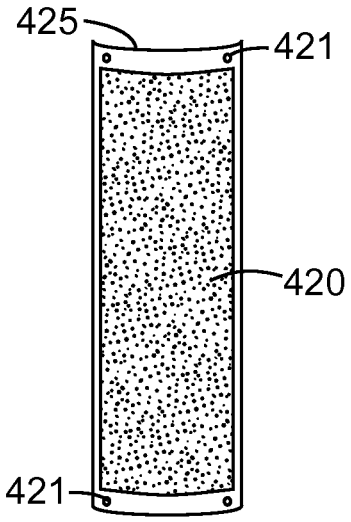
Figure 4D:
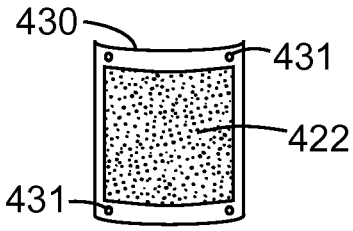
Figure 4E:
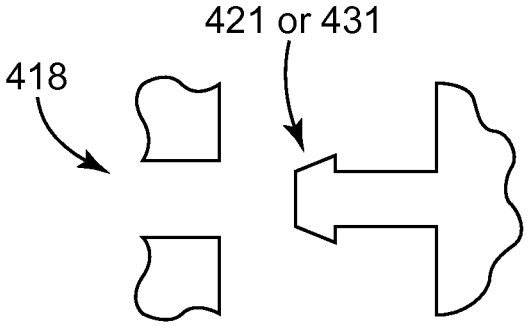
FIG. 4*e* is a magnified schematic sectional view of mounting features that can be used to attach a positioning member to a delineator body.

FIGS. 4*b*, 4*c*, 4*d*, which have already been mentioned above, are schematic elevational views of individual components of the delineator of FIG. 4, and FIG. 4*e* is a magnified schematic sectional view of mounting features that can be used to attach a cover member to a delineator body. The delineator 412 is shown without the positioning members 425, 430 in FIG. 4*b*. The positioning member 425, with the attached reflective sheet 420, is shown in FIG. 4*c*. The positioning member 430, with the attached reflective sheet 422, is shown in FIG. 4*d*. Positioning member 425 includes mounting features 421, and positioning member 430 includes mounting features 431. These mounting features 421, 431 may be posts, pins, or the like, or they may be holes. These mounting features are spaced so that they can mate with one, or preferably more, mounting features 418 provided on delineator body 412. Mounting features 418 may be suitably sized and spaced holes, for example.

In exemplary embodiments, the size and shape of the window regions are coordinated with the size and shape of the reflective sheet(s) attached to the positioning member(s) so that some or all of the edges of the sheet(s) are securely covered by the delineator body and not exposed through the window region(s) when the cover member is securely mated to the delineator body, to prevent removal of the reflective sheet(s) or other tampering by vandals.

In FIG. 4*e*, a mounting feature 418 of the delineator body 412 is shown juxtaposed with a mounting feature 421 or 431 of positioning member 425 or 430, respectively. As shown, the mounting feature 421 or 431 may be a protrusion that is suitably shaped and sized to mate with a hole that forms mounting feature 418. Depending on design details of the protrusion and the hole, mating between the two parts may be made to be reversible, thus allowing for re-positioning of the positioning member and re-configuration of the delineator, or it may be substantially irreversible, to allow for only one selected placement of the positioning member, after which an attempted removal of the positioning member from the delineator body may result in damage to one or both components. In some embodiments, protrusions such as that shown in FIG. 4*e* may be provided as mounting features on the delineator body, while suitable holes may be provided as mounting features on the positioning member(s). Alternatively, holes may be provided on both the delineator body and the positioning member(s), the position and spacing of the holes being designed to align with each other (and mate with each other via suitable screws, rivets, or the like) when the positioning member is placed at specified locations on the delineator body.

Figure 5A:
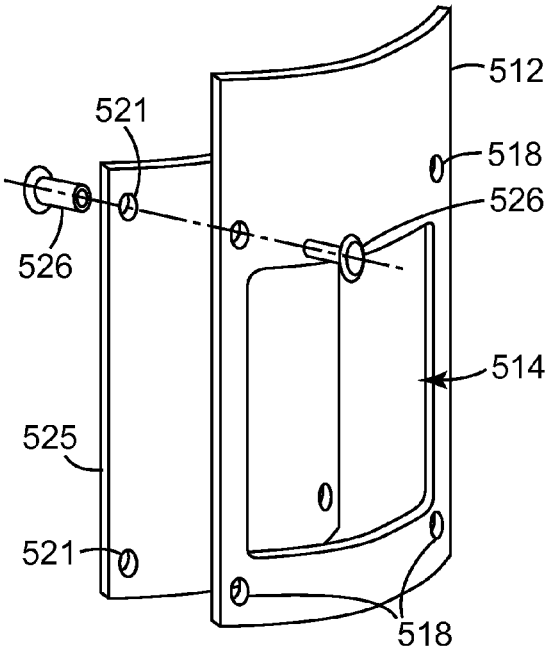
FIGS. 5*a*, 5*b*, and 5*c* are perspective views of portions of alternative delineators, showing alternative mounting features that can be used to attach a positioning member to a delineator body.
Figure 5B:
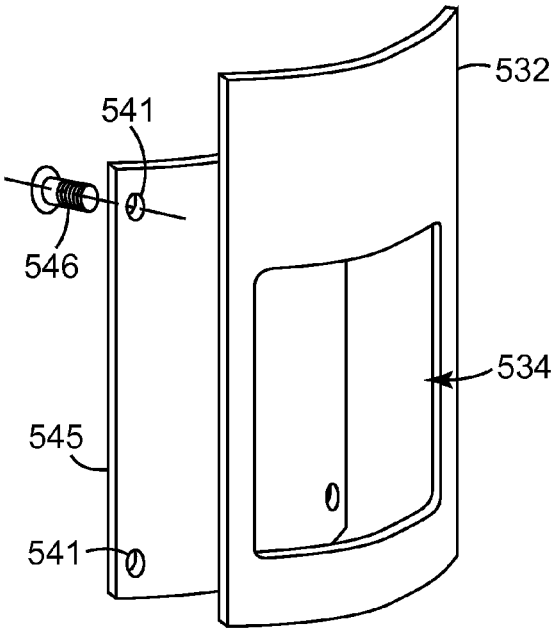
Figure 5C:
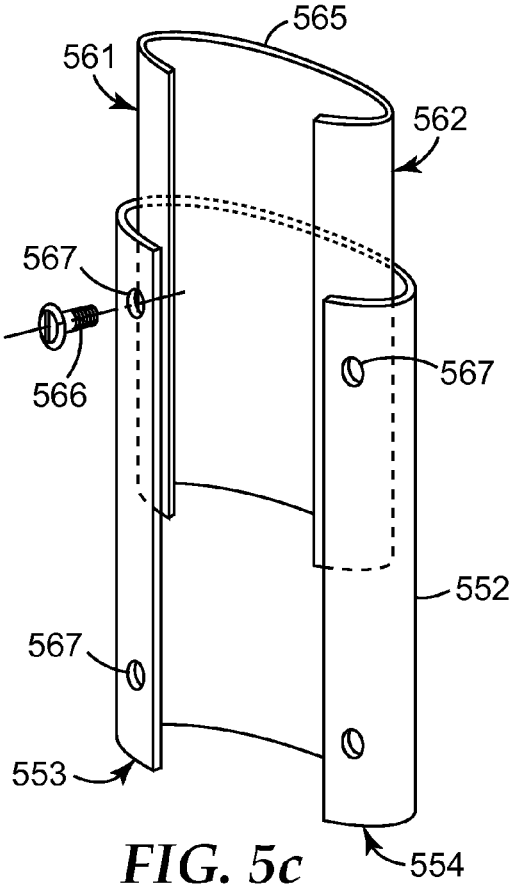

FIGS. 5*a*, 5*b*, and 5*c* are perspective views of portions of alternative delineators, showing alternative mounting features that can be used to attach a cover member to a delineator body. In FIG. 5*a*, a portion of a delineator body 512, which is provided with an aperture or window region 514, also has mounting features 518 in the form of suitably sized and spaced holes. A positioning member 525, onto which a reflective sheet (not shown) may be bonded, has mounting features 521 in the form of corresponding holes. A rivet 526 may be used at each hole-hole pair to mate the respective mounting features together and firmly attach the positioning member 525 at one of a plurality of specific locations or positions on the delineator body.

In FIG. 5*b*, a portion of a delineator body 532, which is provided with an aperture or window region 534, also has mounting features in the form of suitably sized and spaced blind holes formed in a back surface thereof (not visible from the perspective of FIG. 5*b*). A positioning member 545, onto which a reflective sheet (not shown) may be bonded, has mounting features 541 in the form of holes that correspond in position to the blind holes of delineator body 532. A screw 546 may be used at each hole-blind hole pair to mate the respective mounting features together and firmly attach the positioning member 545 at one of a plurality of specific locations or positions on the delineator body.

In FIG. 5*c*, a portion of a delineator body 552, which is provided with an aperture or window region (not shown), also has mounting features in the form of channels 553, 554 that result from the bent ends of the body 552. A positioning member 565, onto which a reflective sheet (not shown) may be bonded, has mounting features 561, 562 in the form of edges of the member 565 that are sized and shaped to slidably engage the channels 553, 554, respectively. In some embodiments, the relative size and shape of the components can be tailored such that a relatively tight friction fit is achieved, whereby no additional mounting features need be used to hold the positioning member in a selected position on the delineator body. If the friction fit is not too tight, the positioning member may be repositioned as desired after an initial configuration. In some embodiments, the fit between the components may be substantially looser, such that additional mounting features such as mounting features 567 in the form of holes on the delineator body 552, may be provided. A screw 566 may be threaded into one or more of the features 567 to secure the positioning member in place on the delineator body. Whether or not the additional mounting features are provided, the positioning member 565 may be positioned at any place within a continuous range of possible positions.

Figures 6A, 6B, 6C:
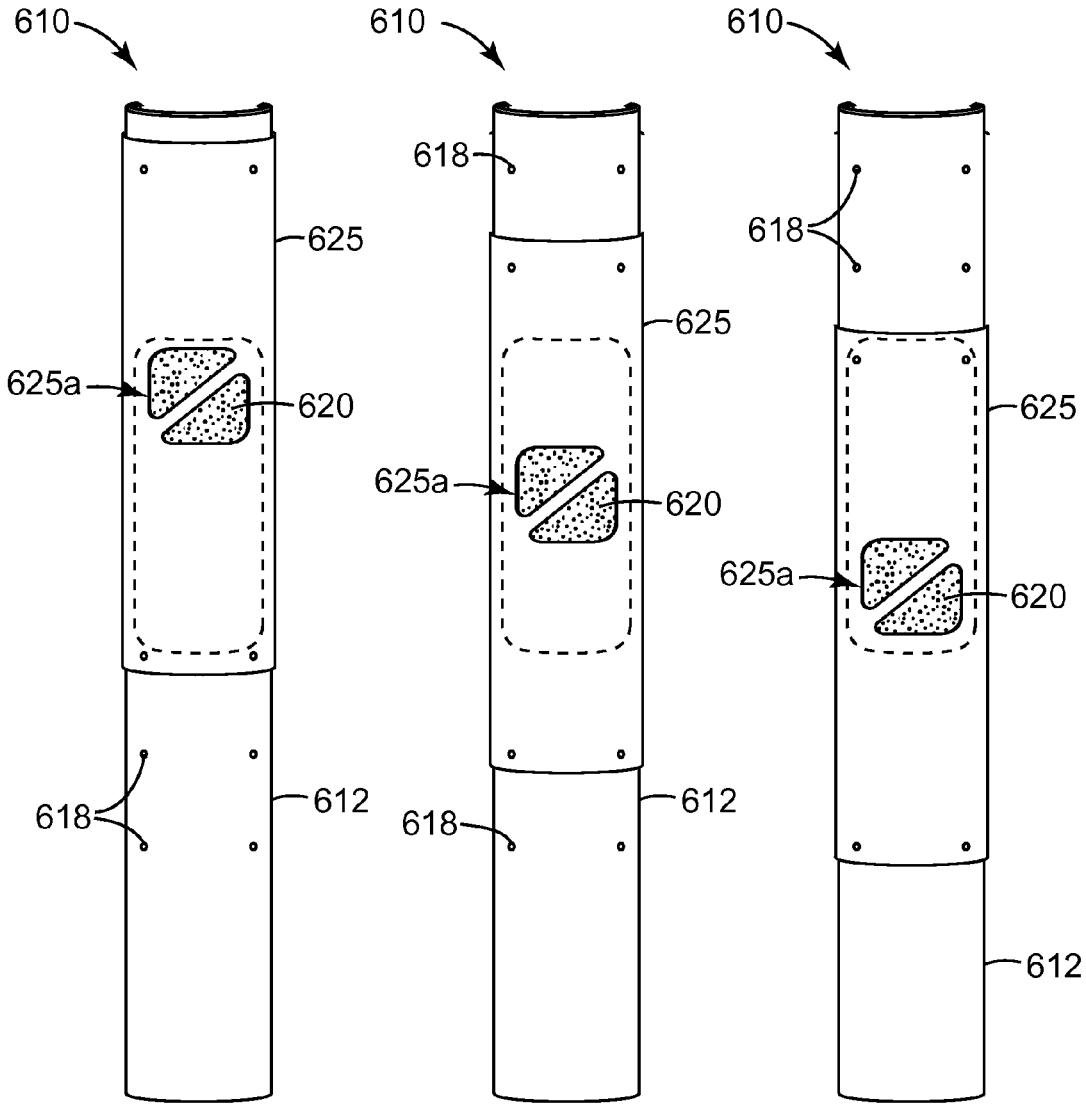
FIGS. 6*a*, 6*b*, and 6*c* are schematic elevational views showing the same delineator having three different visibility configurations as a result of a positioning member being positioned at three different positions on the delineator body.

FIGS. 6*a*, 6*b*, and 6*c* are schematic elevational views showing a given delineator 610 having three different visibility configurations as a result of a positioning member 625 being positioned at three different positions on a delineator body 612. The delineator body 612 may have mounting features 618 in the form of holes or protrusions, for example, and the positioning member 625 may have corresponding protrusions or holes, respectively, formed on an interior surface of the positioning member (not visible in FIGS. 6*a-c*). Alternatively, the positioning member 625 may have a shape whose interior surface slidably mates with the exterior surface of the delineator body 612, e.g. in a friction fit to permit continuous or discrete repositioning of the member 625 at any desired height of the body 612. A reflective sheet 620 is bonded to an exterior surface of the body 612, with the edge of the sheet 620 shown in broken lines. At each of the depicted positions of the positioning member 625, a portion of the sheet 625 is visible through a window region 625*a* in the member 625, and a portion of the sheet 625 is covered by the member 625. In all of the depicted positions, all of the edges of the sheet 625 are covered by the member 625. By positioning or repositioning the positioning member 625 from a first or highest position (FIG. 6*a*), to a second or middle position (FIG. 6*b*), to a third or lowest position (FIG. 6*c*), the position of the exposed portion of the reflective sheet can be moved from a high to a low position, thus changing the visibility configuration of the delineator 610.

In an alternative embodiment to that of FIGS. 6*a-c*, the reflective sheet 620 can be subdivided into three smaller reflective sheets that have a different color or different other optical properties, so that the change in position associated with FIGS. 6*a-c* is accompanied by a change in apparent color or other optical property as each smaller sheet is sequentially exposed from one position to the next.

Figure 7:
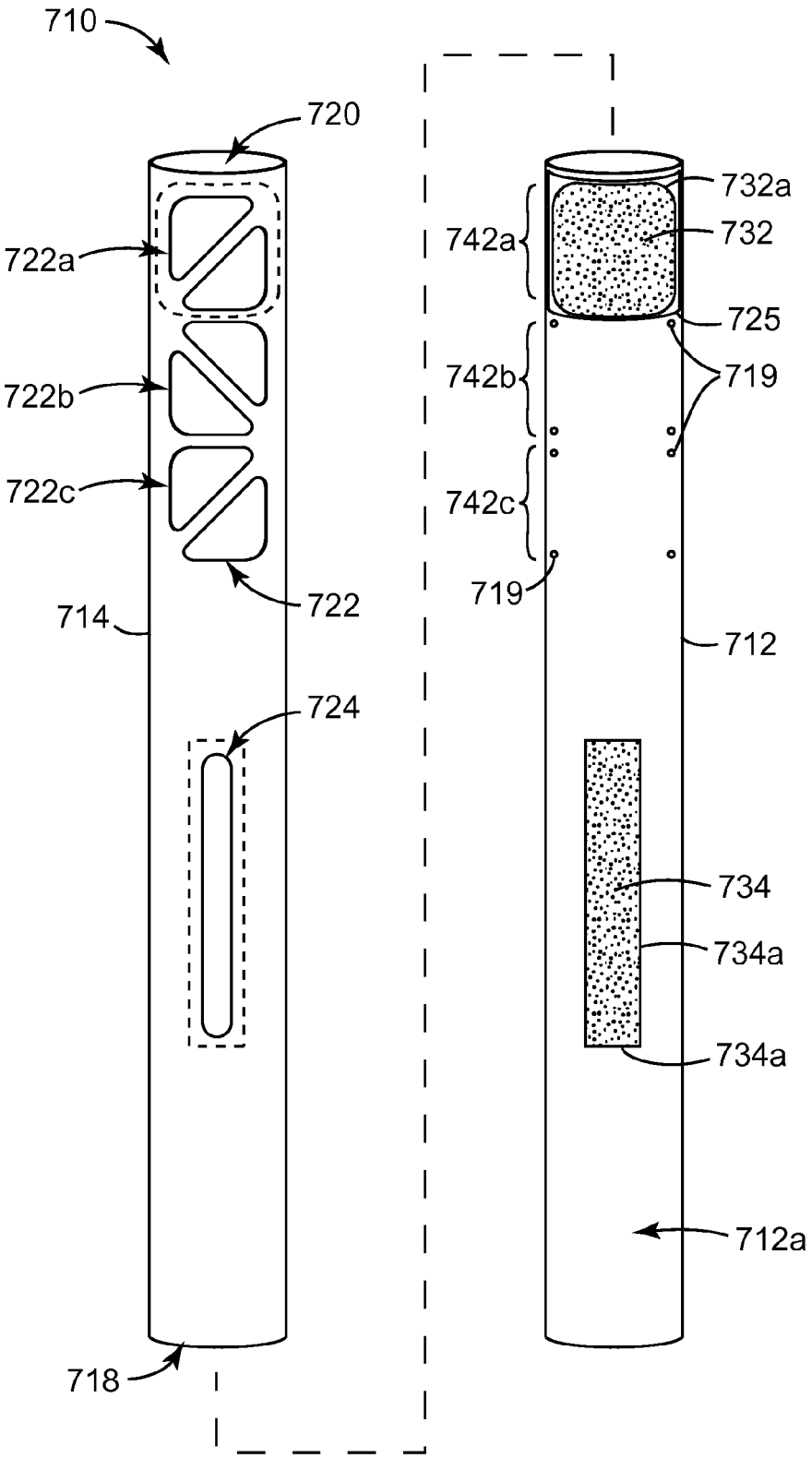
FIG. 7 is a schematic exploded view of a configurable delineator having a core/shell construction.

The disclosed configurable and re-configurable delineators may have a core/shell construction as shown in the schematic exploded view of FIG. 7. Further description of core/shell delineator constructions, and advantages of such constructions, can be found in U.S. Patent Application 61/288,581, "Delineator With Core/Shell Construction", filed Dec. 21, 2009 and incorporated herein by reference. In FIG. 7, a delineator 710 has a two-part delineator body, comprising an outer shell 714 and an inner core 712 designed to slide into a lower end 718 of the shell 714 opposite an upper end 720. A separate base (not shown) may also be provided.

The shell 714 has a first window region 722 and a second window region 724, although less than two or more than two window regions can also be used. In fact, the window region 722 may also be considered to comprise three smaller distinct window regions 722*a*, 722*b*, 722*c*. The window regions may comprise apertures formed in the shell 414. Selected ones of the window regions are effective to expose or reveal reflective sheeting that is located inside the outer shell depending on the position of a positioning member and associated reflective sheet on the inner core 712 as set forth further below. The window regions can be configured such that they do not expose at least some of, and in some cases they do not expose any of, the edges of the reflective sheeting. In the view of FIG. 7, reflective sheeting is indicated by shading, and edges of the respective sheets (732*a* for reflective sheet 732, and 734*a* for reflective sheet 734) that are visible on the right-hand side of the figure are shown in broken outline format on the left-hand side of the figure to indicate the position of the inner core in the outer shell when the delineator is fully assembled. The sheeting edges are preferably covered up by portions of the outer shell proximate the window regions, so that vandals have little or no access to the sheeting edges and will be less likely to remove the reflective sheeting from the delineator. It can also be beneficial to provide a relatively close fit between the inner core and the outer shell so as to avoid significant gaps between the outer shell and the reflective sheeting. This can help to further reduce access to the reflective sheeting.

A first reflective sheet 732 is bonded to a positioning member 725, which has mounting features (not shown in the figure, but which may for example be provided on a back surface of the member 725) configured to mate with one or more mounting features 719 formed on the core 712. The mounting features on the two components are tailored to allow the positioning member 725 to be selectively attached and optionally re-attached to the inner core 712 at any of the distinct positions 742*a*, 742*b*, 742*c*, whereby the reflective sheet 732 is visible at the window region 722*a*, 722*b*, or 722*c* when the delineator is fully assembled. A second reflective sheet 734 attaches directly to an outer surface 712*a* of the inner core 712 rather than to a separate positioning member. Hence, regardless of the position of positioning member 725 (and reflective sheet 732), the reflective sheet will always be visible at the window region 724 when the delineator is fully assembled.

Figure 8:
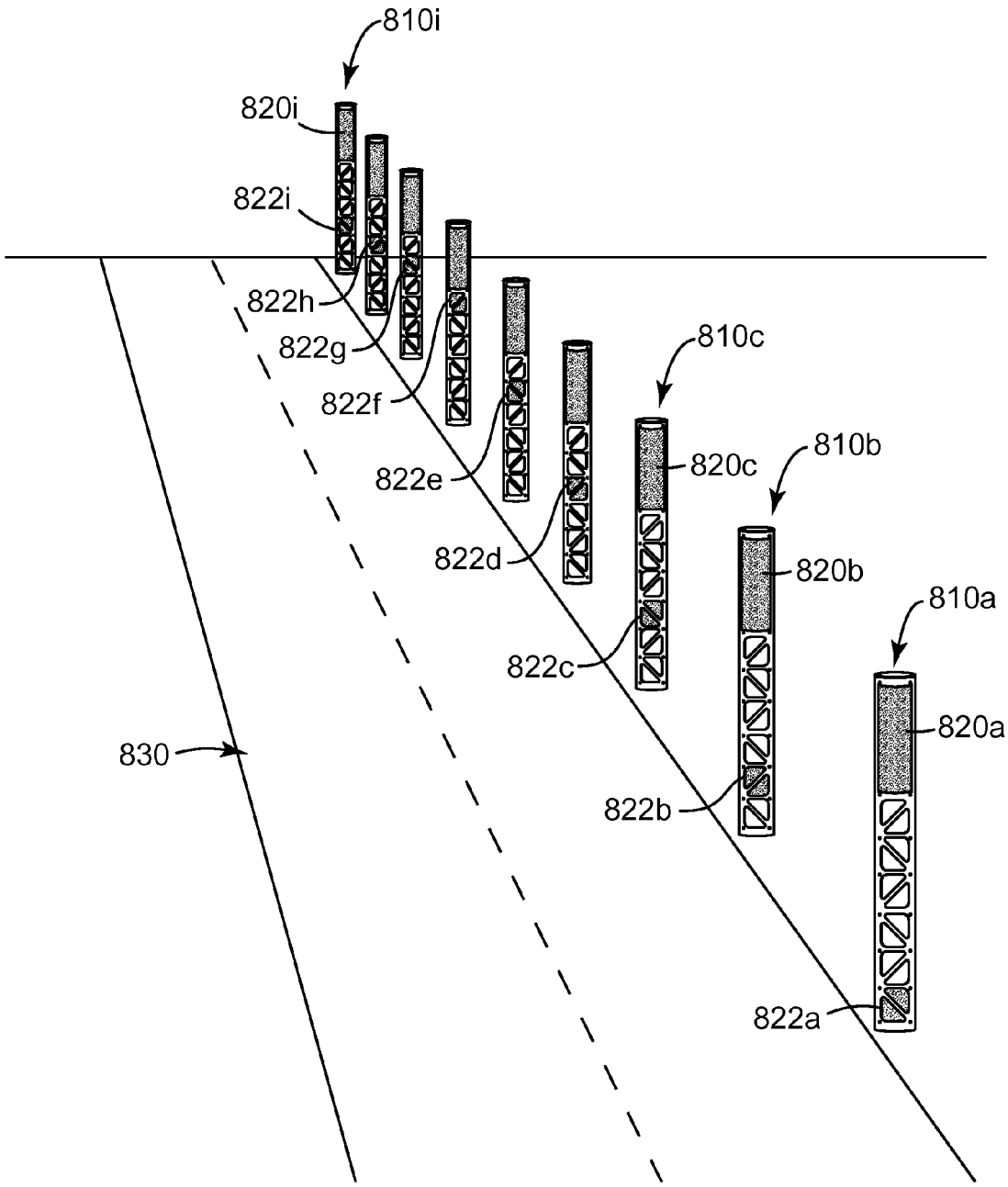
FIG. 8 is a perspective view of a roadway with a set of delineators arranged along the roadway, the delineators having different visibility configurations that collectively define a distinctive wave-like pattern.

FIG. 8 is a perspective view of a roadway 830 with a set of delineators 810*a-i* arranged along the roadway, the delineators having different visibility configurations that collectively define a distinctive wave-like pattern. By configuring or reconfiguring the delineators in a specified arrangement of visibility configurations, a wide variety of different patterns can be formed. In FIG. 8, the delineators 810*a*, 810*b*, 810*c*, etc. each have a first (fixed) reflective sheet 820*a*, 820*b*, 820*c*, etc., and a second (configurable and optionally reconfigurable) reflective sheet 822*a*, 822*b*, 822*c*, etc. The arrangement of configurable reflective sheets 822*a-i* form a distinctive wave-like pattern or other desired pattern from the point of view of a vehicle operator traveling along the roadway 830.

Figure 9A:
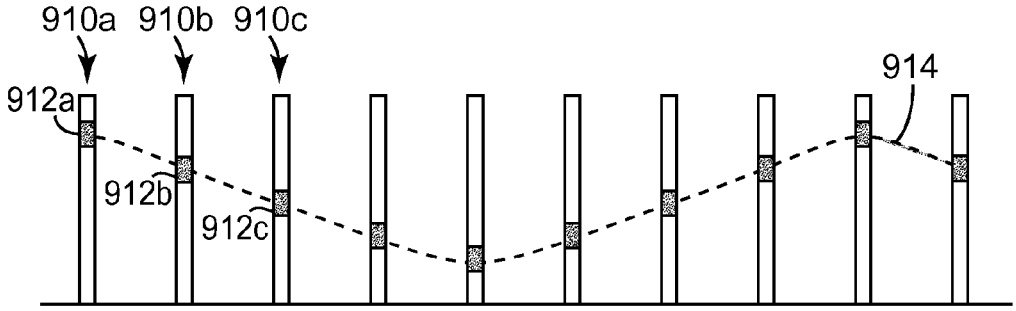
FIGS. 9*a-d* are schematic side views of other sets of delineators having different combinations of visibility configurations to collectively define different patterns.
Figure 9B:
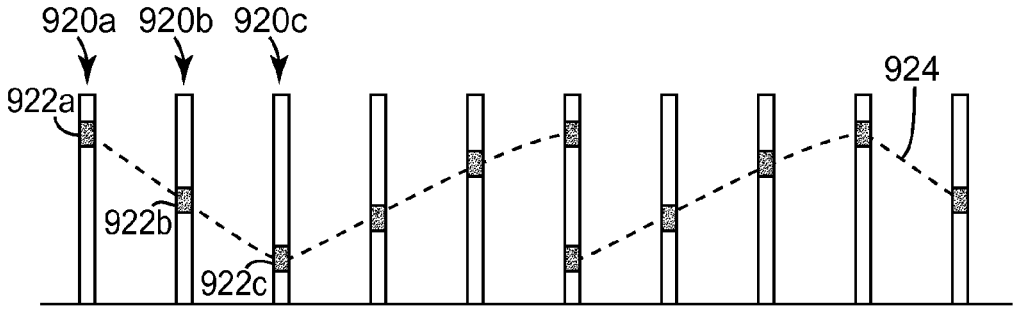
Figure 9C:
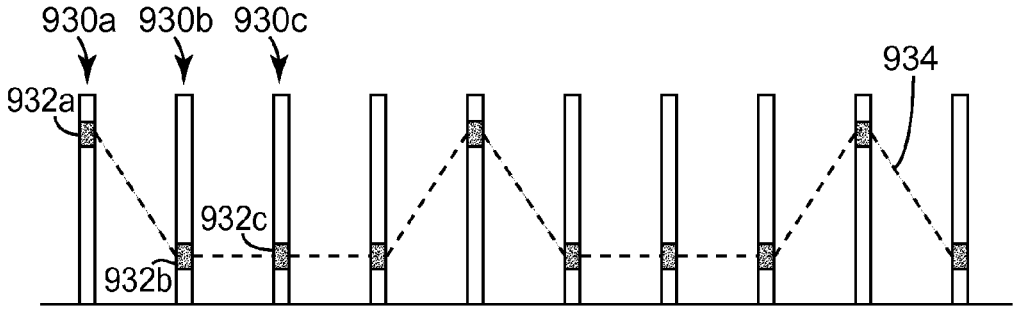
Figure 9D:
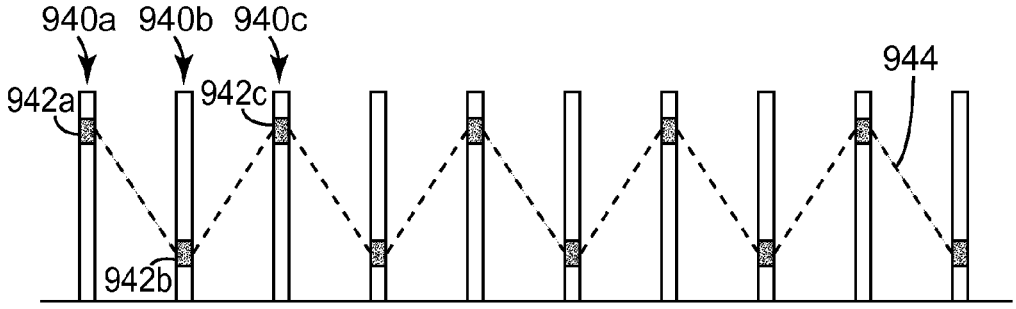

FIGS. 9*a-d* are schematic side views of other sets of configurable delineators arranged along a roadway, the delineators having different combinations of visibility configurations to collectively define different wave-like patterns. In FIG. 9*a*, delineators 910*a*, 910*b*, 910*c*, etc. have configurable reflective sheets 912*a*, 912*b*, 912*c*, etc. arranged to form a sinusoidally-shaped wave pattern 914. In FIG. 9*b*, delineators 920*a*, 920*b*, 920*c*, etc. have configurable reflective sheets 922*a*, 922*b*, 922*c*, etc. arranged to form a broken sinusoidally-shaped wave pattern 924. In FIG. 9*c*, delineators 930*a*, 930*b*, 930*c*, etc. have configurable reflective sheets 932*a*, 932*b*, 932*c*, etc. arranged to form a staggered triangle-shaped wave pattern 934. In FIG. 9*d*, delineators 940*a*, 940*b*, 940*c*, etc. have configurable reflective sheets 942*a*, 942*b*, 942*c*, etc. arranged to form a sawtooth-shaped wave pattern 944.

The disclosed delineators are preferably composed of suitable plastics and/or other durable materials. In some cases, the delineators may be designed to be substantially rigid and inflexible. In other cases, the delineators may be designed to be flexible so that they can bend by 90 degrees or more in response to a vehicle strike, and then rebound or recover to a vertical orientation. The choice of design may affect the choice of materials used for delineator body. In a flexible design, the delineator body or portions thereof, and the positioning member, may be made of a thermoplastic polyurethane, such as such as Desmopan™ 392LS/LE material sold by Bayer, or other suitable flexible materials such as a flexible rubber-like plastic or other plastic. In a rigid design, the delineator body or portions thereof, and the positioning member, may be made of a harder plastic, such as polycarbonate 15% glass filled, polycarbonate acrylonitrile butadiene styrene (ABS) glass filled, nylon glass filled, sheet metal, or other suitable rigid materials.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Various modifications and alterations of this invention will be apparent to those skilled in the art without departing from the spirit and scope of this invention, and it should be understood that this invention is not limited to the illustrative embodiments set forth herein. For example, the reader should assume that features of one disclosed embodiment can also be applied to all other disclosed embodiments unless otherwise indicated. It should also be understood that all U.S. patents, patent application publications, and other patent and non-patent documents referred to herein are incorporated by reference, to the extent they do not contradict the foregoing disclosure.

The invention claimed is:

1. A delineator, comprising:

a delineator body comprising one or more first mounting features;

a positioning member comprising one or more second mounting features, the one or more second mounting features being adapted to mate with the one or more first mounting features at a plurality of positions corresponding to different positions of the positioning member on the delineator body; and a first reflective sheet bonded to the positioning member, or bonded to the delineator body at one or more of the different positions;

wherein the user selects a visibility configuration of the delineator by selecting one of the different positions of the positioning member on the delineator body.

2. A delineator, comprising:

a delineator body comprising one or more first mounting features;

a positioning member comprising one or more second mounting features, the one or more second mounting features being adapted to mate with the one or more first mounting features at a plurality of positions corresponding to different positions of the positioning member on the delineator body; and a first reflective sheet bonded to the positioning member, or bonded to the delineator body at one or more of the different positions;

wherein the positioning member attaches to the delineator body at one of the different positions to provide a visibility configuration of the delineator.

3. The delineator of claim 1, wherein the first reflective sheet is bonded to the positioning member.

4. The delineator of claim 3, wherein the delineator body comprises a plurality of window regions, and the positioning member is positioned or positionable at a selected set of the window regions such that the reflective sheet is visible through the selected set of window regions.

5. The delineator of claim 4, wherein the selected set of window regions is only one of the window regions.

6. The delineator of claim 4, wherein the selected set of window regions is two or more of the window regions.

7. The delineator of claim 1, wherein the one or more first mounting features comprise a first arrangement of holes formed in the delineator body.

8. The delineator of claim 1, wherein the one or more first mounting features comprise a first arrangement of protrusions formed in the delineator body.

9. The delineator of claim 1, wherein the one or more first mounting features comprise a channel formed in the delineator body.

10. The delineator of claim 9, wherein the one or more second mounting features comprise an edge of the positioning member adapted to slidably mate with the channel.

11. The delineator of claim 1, wherein the one or more second mounting features comprise a second arrangement of holes formed in the positioning member.

12. The delineator of claim 1, wherein the one or more second mounting features comprise a second arrangement of protrusions formed in the positioning member.

13. The delineator of claim 1, wherein the first reflective sheet is bonded to the delineator body, and wherein the positioning member is sized to cover at least a portion of the first reflective sheet.

14. The delineator of claim 13, wherein the positioning member is sized to cover only a portion of the first reflective sheet.

15. The delineator of claim 13, further comprising:

a second reflective sheet bonded to the delineator body at a different position than the first reflective sheet;

2 wherein the positioning member is sized to cover substantially all of the first reflective sheet.

16. The delineator of claim 1, wherein the different positions of the positioning member on the delineator body comprise a first and second position having different heights on the delineator body.

17. The delineator of claim 1, wherein the mating of the one or more second mounting features with the one or more first mounting features is achieved via one or more rivets, screws, and/or pins.

18. The delineator of claim 1, wherein the first and second mounting features are configured to allow the positioning member to be repositioned from one to another of the different positions.

19. The delineator of claim 1, wherein the different positions comprise different discrete positions.

20. The delineator of claim 1, wherein the different positions comprise a continuous range of different positions.

* * * * *

UNITED STATES PATENT AND TRADEMARK OFFICE

CERTIFICATE OF CORRECTION

PATENT NO. : 8,888,302 B2
APPLICATION NO. : 13/519962
DATED : November 18, 2014
INVENTOR(S) : Korah B. Philip It is certified that error appears in the above-identified patent and that said Letters Patent is hereby corrected as shown below:

In the Specification

Column 9
Line 1, delete "61/288,581," and insert -- 61/288,581, (Attorney Docket No. 65819US002), --, therefor.

In the Claims

Column 12
Line 23 (Approx.), in Claim 15, delete "2 wherein" and insert -- wherein --, therefor.

Signed and Sealed this
Eleventh Day of August, 2015

Michelle K. Lee

Michelle K. Lee
*Director of the United States Patent and Trademark Office*